US005234888A

United States Patent [19]

Defieuw et al.

[11] Patent Number: 5,234,888

[45] Date of Patent: Aug. 10, 1993

[54] DYE-DONOR ELEMENT FOR USE ACCORDING TO THERMAL DYE SUBLIMATION TRANSFER

[75] Inventors: Geert H. Defieuw, Kessel-Lo; Emiel A. Verdonck, Berlaar; Luc A. Van Steen, Antwerp, all of Belgium

[73] Assignee: Agfa-Gevaert, N.V., Mortsel, Belgium

[21] Appl. No.: 921,087

[22] Filed: Jul. 29, 1992

[51] Int. Cl.[5] ..... B41M 5/035; B41M 5/38

[52] U.S. Cl. ..... 503/227; 428/41; 428/195; 428/913; 428/914

[58] Field of Search ..... 8/471; 428/195, 41, 428/913, 914; 503/227

[56] References Cited

FOREIGN PATENT DOCUMENTS 2294591 12/1987 Japan ..... 503/227

*Primary Examiner*—Pamela R. Schwartz
*Attorney, Agent, or Firm*—Breiner & Breiner

[57] ABSTRACT

Dye-donor element for use according to thermal dye sublimation transfer comprising a support having on one side a dye layer and on the other side a heat-resistant layer, characterized in that said heat-resistant layer comprises a polycarbonate derived from a bis-(hydroxyphenyl)-cycloalkane (diphenol) corresponding to formula (I)

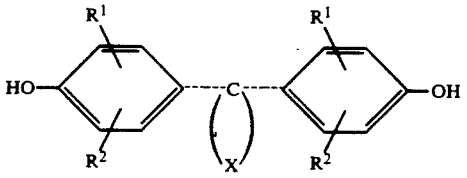

(I)

wherein:

$R^1$ and $R^2$ (same or different) represent hydrogen, halogen, a $C_1$-$C_8$ alkyl group, a $C_5$-$C_6$ cycloalkyl group, a $C_6$-$C_{10}$ aryl group or a $C_7$-$C_{12}$ aralkyl group;

X represents the necessary atoms to close a 5- to 8-membered cycloaliphatic ring which is substituted with one or more $C_1$-$C_6$ alkyl groups or 5- or 6-membered cycloalkyl groups or carries fused-on 5- or 6-membered cycloalkyl groups.

15 Claims, No Drawings

DYE-DONOR ELEMENT FOR USE ACCORDING TO THERMAL DYE SUBLIMATION TRANSFER

DESCRIPTION

1. Field of the Invention

The present invention relates to dye-donor elements for use according to thermal dye sublimation transfer and in particular to a heat-resistant layer of said dye-donor element.

2. Background of the Invention

Thermal dye sublimation transfer also called thermal dye diffusion transfer is a recording method in which a dye-donor element provided with a dye layer containing sublimable dyes having heat transferability is brought into contact with a receiver sheet and selectively, in accordance with a pattern information signal, heated with a thermal printing head provided with a plurality of juxtaposed heat-generating resistors, whereby dye from the selectively heated regions of the dye-donor element is transferred to the receiver sheet and forms a pattern thereon, the shape and density of which is in accordance with the pattern and intensity of heat applied to the dye-donor element.

A dye-donor element for use according to thermal dye sublimation transfer usually comprises a very thin support e.g. a polyester support, one side of which is covered with a dye layer, which contains the printing dyes. Usually an adhesive or subbing layer is provided between the support and the dye layer.

Due to the fact that the thin support softens when heated during the printing operation and then sticks to the thermal printing head thereby causing malfunctioning of the printing apparatus and reduction in image quality the backside of the support (side opposite to the dye layer) is typically provided with a heat-resistant layer to facilitate passage of the dye-donor element under the thermal printing head. An adhesive layer may be provided between the support and the heat-resistant layer.

The heat-resistant layer generally comprises a lubricating material and a binder. In the conventional heat-resistant layers the binder is either a cured binder (as described in, for example, EP 153880, EP 194106, EP 314348, EP 329117, JP 60/151096, JP 60/229787, JP 60/229792, JP 60/229795, JP 62/48589, JP 62/212192, JP 62/259889, JP 01/5884, JP 01/56587, JP 02/128899) or a polymeric thermoplast (as described in, for example, EP 267469, JP 58/187396, JP 63/191678, JP 63/191679, JP 01/234292, JP 02/70485).

A disadvantage of cured binders is their cumbersome manufacture requiring relatively long curing times.

Polymeric thermoplasts known for use as binder for the heat-resistant layer such as i.a. poly(styrene-co-acrylonitrile), polystyrene and polymethylmethacrylate have the disadvantage of having a relatively low glass transition temperature (around 100° C.) leading to a relatively low heat stability of the heat-resistant layer containing said binder en therefore to unsatisfactory performance of said heat-resistant layer. Further when dye-donor elements having such heat-resistant layers have been rolled up and stored for any length of time such that the backcoat of one portion of the donor element is held against the dyecoat of another portion, migration of the dye takes place leading to a loss of density of any prints eventually made using that donor element.

Polycarbonates derived from bisphenol A have higher glass transition temperatures but these polymers are not soluble in ecologically acceptable solvents such as ketones. It is preferred to use ecologically acceptable solvents as solvent for the coating solution of the heat-resistant layer.

The polycarbonates described in JP 62/294591 are also not soluble in ecologically acceptable solvents.

SUMMARY OF THE INVENTION

It is an object of the present invention to provide heat-resistant layers not having the disadvantages mentioned above.

According to the present invention a dye-donor element for use according to thermal dye sublimation transfer is provided, said dye-donor element comprising a support having on one side a dye layer and on the other side a heat-resistant layer, characterized in that said heat-resistant layer comprises a polycarbonate derived from a bis-(hydroxyphenyl)-cycloalkane (diphenol) corresponding to formula (I)

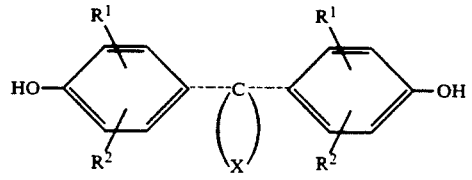

(I)

wherein:

$R^1$ and $R^2$ (same or different) represent hydrogen, halogen, a $C_1$-$C_8$ alkyl group, a $C_5$-$C_6$ cycloalkyl group, a $C_6$-$C_{10}$ aryl group or a $C_7$-$C_{12}$ aralkyl group;

X represents the necessary atoms to close a 5- to 8-membered cycloaliphatic ring which is substituted with one or more $C_1$-$C_6$ alkyl groups or 5- or 6-membered cycloalkyl groups or carries fused-on 5- or 6-membered cycloalkyl groups.

The polycarbonates for use according to the present invention have higher glass transition temperatures (typically in the range of about 160° C. to about 260° C.) than polycarbonates derived from bisphenol A (Tg about 150° C.). Heat-resistant layers containing said polycarbonates show better heat stability than heat-resistant layers containing conventional polymeric thermoplasts and show good stability of the dye-donor element when stored in rolled or folded form. Further said polycarbonates are soluble in ecologically acceptable solvents such as methylethylketone and ethylacetate and thus heat-resistant layers containing said polycarbonates can be manufactured in a more convenient and ecologically acceptable way than heat-resistant layers containing bisphenol A polycarbonates.

Homopolycarbonates according to the present invention have a glass transition temperature of 240° C. Homopolycarbonates of formula I wherein X is a non-substituted cycloaliphatic ring have lower glass transition temperatures (in the range of 170° C.) and thus heat-resistant layers containing said polycarbonates show less heat stability. Further said latter polycarbonates are not soluble in methylethylketone and ethylacetate. Co-polycarbonates according to the present invention accordingly have higher glass transition temperatures than co-polycarbonates of formula I wherein X is a non-substituted cycloaliphatic ring.

DETAILED DESCRIPTION OF THE INVENTION

Preferably on to two carbon atoms of X, more preferably only one carbon atom, is dialkyl substituted. A preferred alkyl group is methyl; preferably the carbon atoms in Alpha-position to the di-phenyl-substituted C-atom are not dialkyl substituted; alkyl disubstitution in Beta-position is preferred.

Preferred examples of diphenols for use according to the present invention are those with 5- or 6-membered cycloaliphatic rings. Examples of such diphenols are given below.

(II)

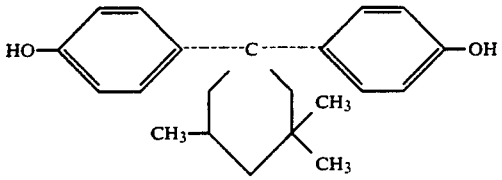

(III)

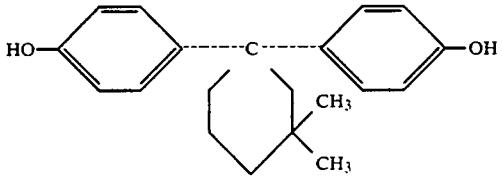

(IV)

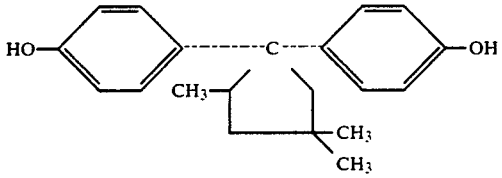

A particularly preferred diphenol is 1,1-bis-(4-hydroxyphenyl)-3,3,5-trimethylcyclohexane (formula (II)).

The bis-(hydroxyphenyl)-cycloalkanes corresponding to formula (I) can be prepared according to a known method by condensation of phenols corresponding to formula (V) and ketones corresponding to formula (VI)

(V)

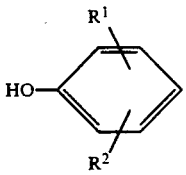

(VI)

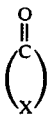

wherein $R^1$, $R^2$ and X have the same significances as given to them in formula (I).

The phenols corresponding to formula (V) are known compounds or can be prepared according to known methods (see for example for cresols and xylenols Ullmanns Encyklopädie der technischen Chemie 4. neubearbeitete und erweiterte Auflage, Band 15, pages 61 to 77, Verlag Chemie-Weinheim-New York 1978; for chlorophenols Ullmanns Encyklopädie der technischen Chemie 4. Auflage, Band 9, pages 573 to 582, Verlag Chemie 1975; and for alkylphenols Ullmanns Encyklopädie der technischen Chemie 4. Auflage, Band 18, pages 191 to 214, Verlag Chemie 1979).

Examples of suitable phenols corresponding to formula (V) are: phenol, o-cresol, m-cresol, 2,6-dimethylphenol, 2-chlorophenol, 3-chlorophenol, 2,6-dichlorophenol, 2-cyclohexylphenol, diphenylphenol and o- or p-benzylphenol.

Ketones corresponding to formula (VI) are known compounds, see for example Beilsteins Handbuch der Organischen Chemie, 7. Band, 4. Auflage, Springer-Verlag, Berlin, 1925 and corresponding Ergänzungsbände 1–4; Journal of American Chemical Society, Vol. 79 (1957), pages 1488, 1490 and 1491; U.S. Pat. No. 2,692,289; Journal of Chemical Society, 1954, pages 2186 and 2191; Journal of Organic Chemistry, Vol. 38, No. 26, 1973, page 4431; Journal of American Chemical Society, Vol. 87, 1965, page 1353 (especially page 1355). A general method for preparing ketones corresponding to formula (VI) is described in, for example, Organikum, 15. Auflage, 1977, VEB-Deutscher Verlag der Wissenschaften, Berlin, page 698.

Examples of suitable ketones corresponding to formula (VI) are:

3,3-dimethylcyclopentanone, 2,2-dimethylcyclohexanone,
3,3-dimethylcyclohexanone, 4,4-dimethylcyclohexanone,
3-ethyl-3-methylcyclopentanone, 2,3,3-trimethylcyclopentanone,
2,4,4-trimethylcyclopentanone, 3,3,4-trimethylcyclopentanone,
3,3-dimethylcycloheptanone, 4,4-dimethylcycloheptanone,
3-ethyl-3-methylcyclohexanone, 4-ethyl-4-methylcyclohexanone,
2,3,3-trimethylcyclohexanone, 2,4,4-trimethylcyclohexanone,
3,3,4-trimethylcyclohexanone, 2,5,5-trimethylcyclohexanone,
3,3,5-trimethylcyclohexanone, 3,4,4-trimethylcyclohexanone,
2,3,3,4-tetramethylcyclopentanone, 2,3,4,4-tetramethylcyclopentanone,
3,3,4,4-tetramethylcyclopentanone, 2,2,5-trimethylcycloheptanone,
2,2,6-trimethylcycloheptanone, 2,6,6-trimethylcycloheptanone,
3,3,5-trimethylcycloheptanone, 3,5,5-trimethylcycloheptanone,
5-ethyl-2,5-dimethylcycloheptanone, 2,3,3,5-tetramethylcycloheptanone,
2,3,5,5-tetramethylcycloheptanone, 3,3,5,5-tetramethylcycloheptanone,
4-ethyl-2,3,4-trimethylcyclopentanone, 2-isopropyl-4,4-dimethylcyclopentanone, 4-isopropyl-2,4-dimethylcyclopentanone,
2-ethyl-3,5,5-trimethylcyclohexanone, 3-ethyl-3,5,5-trimethylcyclohexanone,
3-ethyl-4-isopropyl-3-methyl-cyclopentanone, 4-s-butyl-3,3-dimethylcyclopentanone, 2-isopropyl-3,3,4-trimethylcyclopentanone,
3-ethyl-4-isopropyl-3-methyl-cyclohexanone, 4-ethyl-3-isopropyl-4-methylcyclohexanone, 3-s-butyl-4,4-dimethylcyclohexanone, 3-isopropyl-3,5,5-trimethylcyclohexanone, 4-isopropyl-3,5,5-trimethylcyclohexanone, 3,3,5-trimethyl-5-propylcyclohexanone, 3,5,5-trimethyl-5-propylcyclohexanone, 2-butyl-3,3,4-trimethylcyclopentanone, 2-butyl-3,3,4-trimethylcyclohexanone, 4-butyl-3,3,5-trimethylcyclohexanone, 3-isohexyl-3-methylcyclohexanone, 5-ethyl-2,4-diisopropyl-5-methylcyclohexanone, 2,2-dimethylcyclooctanone, and 3,3,8-trimethylcyclooctanone.

Examples of preferred ketones are:

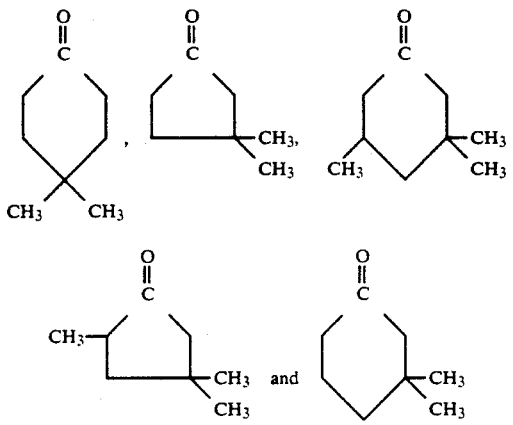

The synthesis of suitable diphenols (I) is described in e.g. DE 3832396. The diphenols (I) are used to prepare high molecular weight thermoplastic aromatic polycarbonates for use according to the present invention.

Homopolycarbonates can be prepared from diphenols corresponding to formula (I) but also copolycarbonates can be prepared by using different diphenols corresponding to formula (I).

The diphenols (I) can also be used in combination with other diphenols not corresponding to formula (I), for examples diphenols corresponding to the formula HO-Z-OH (VII) in the preparation of high molecular weight, thermoplastic, aromatic polycarbonates for use according to the present invention.

Useful diphenols of formula (VII) are diphenols wherein Z represents an aromatic residue having from 6 to 30 C atoms that can contain one aromatic nucleus or more than one aromatic nucleus. The aromatic residue Z may be substituted and may contain aliphatic residues or cycloaliphatic residues (such as the cycloaliphatic residues contained in the diphenols of formula (I)) or heteroatoms as bond between the separate aromatic nuclei.

Examples of diphenols (VII) are: hydrochinon, resorcine, dihydroxydiphenyl, bis-(hydroxyphenyl)-alkane, bis-(hydroxyphenyl)-cycloalkane, bis-(hydroxyphenyl)-sulfide, bis-(hydroxyphenyl)-ether, bis-(hydroxyphenyl)-ketone, bis-(hydroxyphenyl)-sulfone, bis-(hydroxyphenyl)-sulfoxide, Alpha,Alpha'-bis-(hydroxyphenyl)-diisopropylbenzene, and such compounds with alkyl or halogen substituents on the aromatic nucleus.

These and other suitable diphenols (VII) are described in e.g. U.S. Pat. No. 3,028,365, U.S. Pat. No. 2,999,835, U.S. Pat. No. 3,148,172, U.S. Pat. No. 3,275,601, U.S. Pat. No. 2,991,273, U.S. Pat. No. 3,271,367, U.S. Pat. No. 3,062,781, U.S. Pat. No. 2,970,131, U.S. Pat. No. 2,999,846, DE 1570703, DE 2063050, DE 2063052, DE 2211956, FR 1561518 and in "Chemistry and Physics of Polycarbonates", Interscience Publishers, New York, 1964.

Other preferred diphenols (VII) are: 4,4'-dihydroxydiphenyl, 2,2-bis-(4-hydroxyphenyl)-propane, 2,4-bis-(4-hydroxyphenyl)-2-methylbutane, 1,1-bis-(4-hydroxyphenyl)-cyclohexane, Alpha,Alpha'-bis-(4-hydroxyphenyl)-p-diisopropylbenzene, 2,2-bis-(3-methyl-4-hydroxyphenyl)-propane, 2,2-bis-(3-chloro-4-hydroxyphenyl)-propane, bis-(3,5-dimethyl-4-hydroxyphenyl)-methane, 2,2-bis-(3,5-dimethyl-4-hydroxyphenyl)-propane, bis-(3,5-dimethyl-4-hydroxyphenyl)-sulfone, 2,4-bis-(3,5-dimethyl-4-hydroxyphenyl)-2-methylbutane, 1,1-bis-(3,5-dimethyl-4-hydroxyphenyl)-cyclohexane, Alpha,Alpha'-bis-(3,5-dimethyl-4-hydroxyphenyl)-p-diisopropylbenzene, 2,2-bis-(3,5-dichloro-4-hydroxyphenyl)-propane and 2,2-bis-(3,5-dibromo-4-hydroxyphenyl)-propane.

Especially preferred diphenols (VII) are: 2,2-bis-(4-hydroxyphenyl)-propane, 2,2-bis-(3,5-dimethyl-4-hydroxyphenyl)-propane, 2,2-bis-(3,5-dichloro-4-hydroxyphenyl)-propane, 2,2-bis-(3,5-dibromo-4-hydroxyphenyl)-propane and 1,1-bis-(4-hydroxyphenyl)-cyclohexane.

Especially 2,2-bis-(4-hydroxyphenyl)-propane (bisphenol A) is preferred.

Incorporation of bisphenol A in the polycarbonate of the present invention decreases the brittleness of the polycarbonate. This results in a lower degree of scratching of the heat-resistant layer. However, by incorporation of bisphenol A the glass transition temperature is decreased compared to the homopolycarbonate. A compromise between scratching and heat-stability must be found.

One diphenol (VII) can be used in combination with diphenols (I) or two or more of said diphenols (VII) can be used together with diphenols (I).

If in the preparation of polycarbonates according to the present invention the diphenols corresponding to formula (I) are used together with other diphenols, the amount of diphenols of formula (I) in the mixture of diphenols is at least 2 mole %, preferably at least 5 mole %, more preferably at least 10 mole %. It is preferred that the amount of diphenols (I) is the mixture is between 25 and 75 mole %, preferably between 40 and 60 mole %.

The high molecular weight polycarbonates can be prepared according to preparation methods for polycarbonates known in the art. The different diphenols can be incorporated in the polycarbonate in different blocks or the different diphenols can be distributed randomly.

In the preparation of the polycarbonates for use according to the present invention a branching agent may be used. Small amounts, preferably between 0.05 and 2.0 mole % (with respect to the diphenols) of tri-or higher functional compounds, in particular compounds with three or more phenolic groups, are added in order to obtained branched polycarbonates. Some of useful branching agents having with three or more phenolic groups are given hereinafter: phloroglucine, 4,6-dimethyl-2,4,6-tri-(4-hydroxyphenyl)-heptene-2,4,6-dimethyl-2,4,6-tri-(4-hydroxyphenyl)-heptane, 1,3,5-tri-(4-hydroxyphenyl)-benzene, 1,1,1-tri-(4-hydroxyphenyl)-ethane, tri-(4-hydroxyphenyl)-phenylmethane, 2,2-bis-(4,4-bis-(4-hydroxyphenyl)-cyclohexyl)-propane, 2,4-bis-(4-hydroxyphenyl-isopropyl)-phenol, 2,6-bis-(2-hydroxy-5'-methyl-benzyl)-4-methylphenol, 2-(4-hydroxyphenyl)-2-(2,4-dihydroxyphenyl)-propane, orthoterephthalic acid hexa-(4-(4-hydroxyphenyl)-isopropyl)-phenyl) ester, tetra-(4-hydroxyphenyl)-methane, tetra-(4-(4-hydroxyphenyl-isopropyl)-phenoxy)-methane, and 1,4-bis-((4'-4''-dihydroxytriphenyl)-methyl)-benzene.

Examples of some other trifunctional compounds are: 2,4-dihydroxybenzoic acid, trimesic acid, cyanuric chloride and 3,3-bis-(3-methyl-4-hydroxyphenyl)-2-oxo-2,3-dihydroindole.

To terminate the chain elongation in order to control the molecular weight of the polycarbonate monofunctional compounds are used as known in the art in the usual known concentrations. Useful compounds are, for example, phenol, t-butylphenol and other alkyl-$C_1$–$C_7$-substituted phenols. Particularly small amounts of phenols corresponding to formula (VIII) are useful

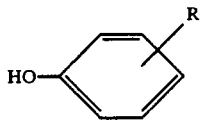

(VIII)

wherein R represents a branched $C_8$- and/or $C_9$-alkyl group. Preferably the contribution of $CH_3$-protons in the alkyl residue R is between 47 and 89% and the contribution of CH- and $CH_2$-protons is between 53 and 11%. Preferably the alkyl residue R is situated in o- and/or p-position with respect to the OH-group, and in particular the ortho substitution amounts to at the most 20%. The compounds used to terminate the chain elongation are in general used in concentrations of 0.5 to 10, preferably 1.5 to 8 mole % with respect to the diphenol content.

The polycarbonates for use according to the present invention can be prepared according to the interfacial polycondensation method as known in the art (see H. Schnell, "Chemistry and Physics of Polycarbonates", Polymer Reviews, Vol. IX, page 33, Interscience Publ., 1964). According to this method the diphenols are solved in aqueous alkaline phase. For the preparation of copolycarbonates mixtures of diphenols of formula (I) and other diphenols are used. In order to control the molecular weight compounds terminating the chain elongation can be added (e.g. compounds of formula VIII). The condensation reaction takes place in the presence of an inert organic phase containing phosgene. Preferably the organic phase that is used is an organic phase capable of dissolving polycarbonate. The reaction temperature is between 0° C. and 40° C.

If branching agents are used they can be added in an amount of 0.05 to 2 mole % to the aqueous alkaline phase together with the diphenols or they can be added to the organic phase before phosgenation takes place.

In addition to the diphenols also their mono- and/or bis-carbonate esters can be used, added in the form of a solution in an organic solvent. The amount of chain terminating agent and branching agent is then leveled against the amount of diphenol structural units; when using chlorocarbonate esters the amount of phosgene can be reduced as known in the art.

Suitable organic solvents for dissolving the chain terminating agent, the branching agent and the chlorocarbonate ester are, for example, methylene chloride, chlorobenzene, acetone, acetonitrile, and mixtures of these solvents, in particular mixtures of methylene chloride and chlorobenzene. Optionally the chain terminating agent and the branching agent are dissolved in the same solvent.

As organic phase for the interfacial condensation are used, for example, methylene chloride, chlorobenzene and mixtures of methylene chloride and chlorobenzene.

As aqueous alkaline phase are used, for example, aqueous NaOH solutions.

The preparation of polycarbonates according to the interfacial polycondensation method can be catalyzed as known in the art by adding catalysts such as tertiary amines, in particular tertiary aliphatic amines such as tributylamine or triethylamine; the catalysts are used in amounts of from 0.05 to 10 mole % with respect to the diphenol content. The catalysts can be added before the start of the phosgenation, during the phosgenation or after the phosgenation.

The isolation of the polycarbonates follows as known in the art.

The polycarbonates for use according to the present invention can also be prepared in homogeneous phase according to a known method (the so-called pyridine method) or according to the known melt ester-interchange process by using, for example, diphenylcarbonate instead of phosgene. Here also the polycarbonates are isolated according to methods known in the art.

Preferably, the molecular weight Mw of the polycarbonates is at least 8000, preferably between 8000 and 200000 and more preferably between 10000 and 80000.

Polycarbonates derived from diphenols corresponding to formula (I) are used as binder in the heat-resistant layer of the dye-donor element according to the present invention in an amount of at least 10% by weight, preferably in an amount from 30 to 100% by weight. A mixture of two or more of said polycarbonates can also be used in the heat-resistant layer.

In addition to said polycarbonates the heat-resistant layer of the dye-donor element according to the present invention can also contain one or more of the conventional thermoplastic binders for heat-resistant layers such as poly(styrene-co-acrylonitrile), poly(vinylalcohol-co-butyral), poly(vinylalcohol-co-acetal), poly(vinylalcohol-co-benzal), polystyrene, poly(vinylacetate), cellulose nitrate, cellulose acetate propionate, cellulose acetate hydrogen phthalate, cellulose acetate, cellulose acetate butyrate, cellulose triacetate, ethyl cellulose, poly(methylmethacrylate), and copolymers of methylmethacrylate. Poly(styrene-co-acrylonitrile) is preferred.

Further the heat-resistant layer of the dye-donor element according to the present invention comprises a lubricating material such as a surface active agent, a liquid lubricant, a solid lubricant or mixtures thereof. The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Particularly preferred lubricants are polysiloxane-polyether copolymers and polytetrafluoroethylene. Suitable lubricants are described in e.g. U.S. Pat. No. 4,753,921, U.S. Pat. No. 4,916,112, U.S. Pat. No. 4,717,711, U.S. Pat. No. 4,717,712, U.S. Pat. No. 4,866,026, U.S. Pat. No. 4,829,050. The amount of lubricant used in the heat-resistant layer depends largely on the type of lubricant, but is generally in the range of from about 0.1 to 50 wt %, preferably 0.5 to 40 wt % of the binder or binder mixture employed.

The heat-resistant layer according to the present invention may contain other additives provided such materials do not inhibit the anti-stick properties of the heat-resistant layer and provided that such materials do not scratch, erode, contaminate or otherwise damage the printhead or harm image quality. Examples of suitable additives are described in EP 389153.

The heat-resistant layer of the thermal dye sublimation transfer donor element according to the present invention is formed preferably by adding the polymeric thermoplastic binder or binder mixture, the lubricant(s), and other optional components to a suitable solvent or solvent mixture, dissolving or dispersing the ingredients to form a coating composition that is applied to a support, which may have been provided first with an adhesive or subbing layer, and dried.

The heat-resistant layer of the dye-donor element may be coated on the support or printed thereon by a printing technique such as a gravure process.

The heat-resistant layer thus formed has a thickness of about 0.1 to 3 μm, preferably 0.3 to 1.5 μm.

As mentioned above the lubricants can be incorporated into the heat-resistant layer. Advantageously, however, a separate top layer comprising at least one lubricant is coated on top of the heat-resistant layer. Preferably, a top layer of a polyether-polysiloxane copolymer, is coated from a non-solvent for the heat-resistant layer on the latter layer. Another preferred separate top layer comprising lubricants has been described in European patent application no. 92 200 229.0.

Preferably a subbing layer is provided between the support and the heat-resistant layer to promote the adhesion between the support and the heat-resistant layer. As subbing layer any of the subbing layers known in the art for dye-donor elements can be used. Suitable binders that can be used for the subbing layer can be chosen from the classes of polyester resins, polyurethane resins, polyester urethane resins, modified dextrans, modified cellulose, and copolymers comprising recurring units such as i.a. vinylchloride, vinylidenechloride, vinylacetate, acrylonitrile, methacrylate, acrylate, butadiene, and styrene (e.g. poly(vinylidenechloride-co-acrylonitrile). Suitable subbing layers are described in e.g. EP 138483, EP 227090, U.S. Pat. No. 4,567,113, U.S. Pat. No. 4,572,860, U.S. Pat. No. 4,717,711, U.S. Pat. No. 4,559,273, U.S. Pat. No. 4,695,288, U.S. Pat. No. 4,727,057, U.S. Pat. No. 4,737,486, U.S. Pat. No. 4,965,239, U.S. Pat. No. 4,753,921, U.S. Pat. No. 4,895,830, U.S. Pat. No. 4,929,592, U.S. Pat. No. 4,748,150, U.S. Pat. No. 4,965,238 and U.S. Pat. No. 4,965,241. Preferably the subbing layer further comprises an aromatic polyol such as 1,2-dihydroxybenzene as described in EP 433496.

Any dye can be used in the dye layer of the dye-donor element of the present invention provided it is transferable to the dye-receiving layer by the action of heat. Examples of suitable dyes are described in, for example, EP 432829, EP 400706, European Patent Application No. 90203014.7, European Patent Application No. 91200218.5, European Patent Application No. 91200791.1, and the references mentioned therein.

The amount ratio of dye or dye mixture to binder is between 9:1 and 1:3 by weight, preferably between 2:1 and 1:2 by weight.

As polymeric binder for the dye layer the following can be used: cellulose derivatives, such as ethyl cellulose, hydroxyethyl cellulose, ethylhydroxy cellulose, ethylhydroxyethyl cellulose, hydroxypropyl cellulose, methyl cellulose, nitrocellulose, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, poly(vinylbutyral-co-vinylacetal-co-vinylalcohol), polyvinyl pyrrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates; poly(styrene-co-acrylonitrile); polysulfones; polyphenylene oxide; organosilicones, such as polysiloxanes; epoxy resins and natural resins, such as gum arabic. Preferably cellulose acetate butyrate or poly(styrene-co-acrylonitrile) is used as binder for the dye layer of the present invention.

The dye layer may also contain other additives, such as thermal solvents, stabilizers, curing agents, preservatives, organic or inorganic fine particles, dispersing agents, antistatic agents, defoaming agents, viscosity controlling agents, etc., these and other ingredients being described more fully in EP 133011, EP 133012, EP 111004 and EP 279467.

Any material can be used as the support for the dye-donor element provided it is dimensionally stable and capable of withstanding the temperatures involved, up to about 400° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a support comprising polyethylene terephthalate. In general, the support has a thickness of 2 to 30 μm. The support may also be coated with an adhesive or subbing layer, if desired. Examples of suitable subbing layers are described, for example, in EP 433496, EP 311841, EP 268179, U.S. Pat. No. 4,727,057, U.S. Pat. No. 4,695,288.

A dye-barrier layer comprising a hydrophilic polymer may also be employed in the dye-donor element between its support and the dye layer to improve the dye transfer densities by preventing wrong-way transfer of dye towards the support. The dye barrier layer may contain any hydrophilic material which is useful for the intended purpose. In general, good results have been obtained with gelatin, polyacryl amide, polyisopropyl acrylamide, butyl methacrylate grafted gelatin, ethyl methacrylate grafted gelatin, ethyl acrylate grafted gelatin, cellulose monoacetate, methyl cellulose, polyvinyl alcohol, polyethylene imine, polyacrylic acid, a mixture of polyvinyl alcohol and polyvinyl acetate, a mixture of polyvinyl alcohol and polyacrylic acid or a mixture of cellulose monoacetate and polyacrylic acid. Suitable dye barrier layers have been described in e.g. EP 227091 and EP 228065. Certain hydrophilic polymers, for example those described in EP 227091, also have an adequate adhesion to the support and the dye layer, thus eliminating the need for a separate adhesive or subbing layer. These particular hydrophilic polymers used in a single layer in the donor element thus perform a dual function, hence are referred to as dye-barrier/-subbing layers.

The support for the receiver sheet that is used with the dye-donor element may be a transparent film of e.g. polyethylene terephthalate, a polyether sulfone, a polyimide, a cellulose ester or a polyvinyl alcohol-co-acetal. The support may also be a reflective one such as baryta-coated paper, polyethylene-coated paper or white polyester i.e. white-pigmented polyester. Blue-colored polyethylene terephthalate film can also be used as support.

To avoid poor adsorption of the transferred dye to the support of the receiver sheet this support must be coated with a special surface, a dye-image-receiving layer, into which the dye can diffuse more readily. The dye-image-receiving layer may comprise, for example, a polycarbonate, a polyurethane, a polyester, a polyamide, polyvinyl chloride, poly(styrene-co-acrylonitrile), polycaprolactone or mixtures thereof. Suitable dye-receiving layers have been described in e.g. EP 133011, EP 133012, EP 144247, EP 227094, EP 228066. The dye-image-receiving layer may also comprise a cured binder such as the heat-cured product of poly(vinylchloride-co-vinylacetate-co-vinylalcohol) and polyisocyanate.

In order to improve the light resistance and other stabilities of recorded images, UV absorbers, singlet oxygen quenchers such as HALS-compounds (Hindered Amine Light Stabilizers) and/or antioxidants may be incorporated into the receiving layer.

The dye layer of the dye-donor element or the dye-image-receiving layer of the receiver sheet may also contain a releasing agent that aids in separating the dye-donor element from the dye-receiving element after transfer. The releasing agents can also be applied in a separate layer on at least part of the dye layer or of the receiving layer. For the releasing agents solid waxes, fluorine- or phosphate-containing surfactants and silicone oils are used. Suitable releasing agents are described in e.g. EP 133012, JP 85/19138, EP 227092.

The thermal dye sublimation transfer printing process comprises placing the dye layer of the doner element in face-to-face relation with the dye-receiving layer of the receiver sheet and imagewise heating from the back of the donor element. The transfer of the dye is accomplished by heating for about several milliseconds at a temperature of about 400° C.

When the process is performed for but one single color, a monochrome dye transfer image is obtained. A multicolor image can be obtained by using a donor element containing three or more primary color dyes and sequentially performing the process steps described above for each color. The above sandwich of donor element and receiver sheet is formed on three occasions during the time when heat is applied by the thermal printing head. After the first dye has been transferred, the elements are peeled apart. A second dye-donor element (or another area of the donor element with a different dye area) is then brought in register with the dye-receiving element and the process repeated. The third color and optionally further colors are obtained in the same manner.

In addition to thermal heads, laser light, infrared flash or heated pens can be used as the heat source for supplying heat energy. Thermal printing heads that can be used to transfer dye from the dye-donor elements of the present invention to a receiver sheet are commercially available. In case laser light is used, the dye layer or another layer of the dye donor-element has to contain a compound that absorbs the light emitted by the laser and converts it into heat, e.g. carbon black.

Alternatively, the support of the dye-donor element may be an electrically resistive ribbon consisting of, for example, a multi-layer structure of a carbon loaded polycarbonate coated with a thin aluminum film. Current is injected into the resistive ribbon by electrically adressing a print head electrode resulting in highly localized heating of the ribbon beneath the relevant electrode. The fact that in this case the heat is generated directly in the resistive ribbon and that it is thus the ribbon that gets hot leads to an inherent advantage in printing speed using the resistive ribbon/electrode head technology compared to the thermal head technology where the various elements of the thermal head get hot and must cool down before the head can move to the next printing position.

The following examples are provided to illustrate the invention in more detail without limiting, however, the scope thereof.

EXAMPLES

A dye-donor element for use according to thermal dye sublimation transfer was prepared as follows:

A solution comprising 5 wt % of dye A, 3 wt % of dye B, 3 wt % of dye C, 2.5 wt % of octanediol as thermal solvent and 6 wt % of poly(styrene-coacrylonitrile) as binder in methylethylketone as solvent was prepared. From this solution a layer having a wet thickness of 10 μm was coated on 6 μm thick polyethylene terephthalate film, provided with a conventional subbing layer. The resulting layer was dried by evaporation of the solvent.

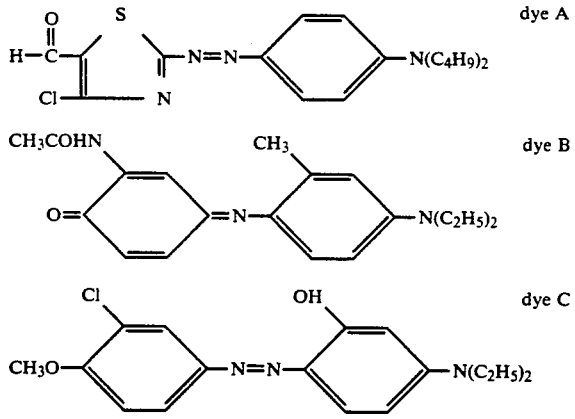

The back side of the polyethylene terephthalate film was provided with a subbing layer coated from a solution in methylethylketone comprising the ingredients as indicated in table 1 below. In example no. 1 and 21 there was no subbing layer provided between the support and the heat-resistant layer.

On top of said subbing layer a heat-resistant layer was provided coated from a solution in methylethylketone containing binder (the nature and amount of which is indicated below in table 1) and 1 wt % of polysiloxanepolyether copolymer (TEGOGLIDE 410 supplied by Goldschmidt) as lubricant.

A receiving element for use according to thermal dye sublimation transfer was prepared as follows:

A receiving layer containing 7.2 g/m$^2$ poly(vinylchloride-co-vinylacetate-co-vinylalcohol) (VINYLITE VAGD supplied by Union Carbide), 0.72 g/m$^2$ diisocyanate (DESMODUR VL supplied by Bayer AG) and 0.2 g/m$^2$ hydroxy modified polydimethylsiloxane (TEGOMER H SI 2111 supplied by Goldschmidt) was provided on a 175 μm thick polyethylene terephthalate film.

The dye-donor element was printed in combination with the receiving element in a Mitsubishi color video printer CP100E.

The receiver sheet was separated from the dye-donor element and the image quality of the obtained image was evaluated by visually checking color drift occurring when overlayed printing is repeated several times leading to decreased sharpness of the transferred image and scratches on the image. Further the damage to the heat-resistant layer after printing was checked by visual inspection on scratches and dullness (is a measure for the heat stability of the heat-resistant layer).

A defect in the performance of the heat-resistant layer causes intermittent rather than continuous transport across the thermal head leading to color drift. Further sticking of the heat-resistant layer to the thermal head leads to damaging of the heat-resistant layer. When abraded or melted parts from the backcoat builds up on the thermal head scratches are induced in the donor element and also in the obtained image on the receiving element.

The backside of the non-printed donor element (the side containing the heat-resistant layer) was subjected to a tape adhesion test. A small piece of transparent tape was firmly pressed by hand over an area of the donor element. Upon manually pulling the tape, removal of the backing layer together with the tape is checked as a measure of the adhesion between the support and the heat-resistant layer. Ideally none of the backing layer would be removed.

The stability of the non-printed donor element in rolled or folded form was checked by storing the donor element in rolled form for 1 hour at 60° C. and by checking whether dye has migrated from the dye layer to the heat-resistant layer.

For all the above visual evaluations the following categories were established: poor (P), fair (F), good (G) and excellent (E).

This experiment was repeated for each of the dye-donor elements identified in table 1 below. The amounts in table 1 are indicated in % by weight in the coating solution (solvent is added up to 100%).

The results are listed in table 2 below.

TABLE 1

| Example No. | Heat-resistant layer | Subbing layer |
|---|---|---|
| Comp | B1 13% | B10 1% + B11 1.5% |
| 1 | B2 13% | |
| 2 | B2 13% | B10 1% + B11 1.5% |
| 3 | B2 13% | B2 1% + B11 1.5% |
| 4 (*) | B2 6.5% + B1 6.5% | B5 1% + B11 1.5% |
| 5 (*) | B2 4% + B1 9% | B5 1% + B11 1.5% |
| 6 (*) | B2 4% + B1 9% | B6 1% |
| 7 (*) | B3 13% | B5 1% + B11 1.5% |
| 8 (*) | B3 13% | B6 1% + B11 1.5% |
| 9 (*) | B3 13% | B6 1% |
| 10 (*) | B3 6.5% + B1 6.5% | B5 1% + B11 1.5% |
| 11 | B4 13% | B10 1% + B11 1.5% |
| 12 | B4 6.5% + B1 6.5% | B10 1% + B11 1.5% |
| 13 | B4 13% | B4 1% + B11 1.5% |
| 14 (**) | B4 13% | B7 1% |
| 15 (**) | B4 13% | B8 1% |
| 16 (**) | B4 13% | B8 1% + B11 1.5% |
| 17 | B4 13% | B6 1% |
| 18 | B4 13% | B6 1% + B11 1.5% |

TABLE 1-continued

| Example No. | Heat-resistant layer | Subbing layer |
|---|---|---|
| 19 (**) | B4 13% | B9 1% |
| 20 (*) | B4 13% | B5 1% + B11 1.5% |
| 21 (*) | B4 13% | |

B1 = poly(styrene-co-acrylonitrile) = Luran 388S supplied by BASF
B2 = polycarbonate derived from 65 mole % bisphenol A and 35 mole % diphenol (II)
B3 = polycarbonate derived from 45 mole % bisphenol A and 55 mole % diphenol (II)
B4 = polycarbonate derived from 100 mole % diphenol (II)
B5 = copolyester = Vitel PE222 supplied by Goodyear
B6 = poly(vinylidenechloride-co-acrylonitrile) = Saran F310 supplied by Dow Chemical
B7 = organic titanate = Tyzor AA supplied by DuPont
B8 = organic titanate = Tyzor TPT supplied by DuPont
B9 = organic titanate = Tyzor DC supplied by DuPont
B10 = polyurethane = Desmocoll 540 supplied by Bayer
B11 = 1,2-dihydroxybenzene
(*) = dye layer does not contain octanediol
(**) = subbing layer coated from a solution in isopropanol instead of methylethylketone

TABLE 2

| Example No. | Tape Test | Color drift | Scratches | Heat stab | Storing |
|---|---|---|---|---|---|
| Comp. | G | G | F | P | P |
| 1 | P | G | F | E | G |
| 2 | P | G | F | E | G |
| 3 | F | G | G | E | G |
| 4 | E | G | G | G | G |
| 5 | E | G | G | F | F |
| 6 | E | F | G | F | F |
| 7 | E | E | E | E | E |
| 8 | E | F | G | E | G |
| 9 | E | F | G | E | G |
| 10 | E | G | G | G | G |
| 11 | P | G | F | E | G |
| 12 | G | G | G | G | G |
| 13 | F | G | G | E | E |
| 14 | F | G | G | E | G |
| 15 | F | G | F | E | G |
| 16 | F | G | G | E | E |
| 17 | E | G | E | E | G |
| 18 | E | F | E | E | G |
| 19 | F | G | E | E | G |
| 20 | G | G | G | E | G |
| 21 | P | G | F | E | F |

The above results show that when a conventional thermoplast is used as binder for the heat-resistant layer (Comparative) the heat stability of the heat-resistant layer is poor and the storing stability of the donor element is poor (diffusion of dye and thermal solvent from the dye layer to the heat-resistant layer) due to the low glass transition temperature (110° C.);

when a polycarbonate according to the present invention is used as binder for the heat-resistant layer the heat stability and the storing stability is improved;

when there is no subbing layer provided between the support and the heat-resistant layer (examples nos. 1 and 21) the adhesion of the heat-resistant layer to the support is poor leading to scratches in the obtained image due to the loosening of the heat-resistant layer during printing.

We claim:

1. Dye-donor element for use according to thermal dye sublimation transfer comprising a support having on one side a dye layer and on the other side a heat-resistant layer, said heat-resistant layer comprising a polycarbonate derived from a bis-(hydroxyphenyl)-cycloalkane (diphenol) corresponding to formula (I)

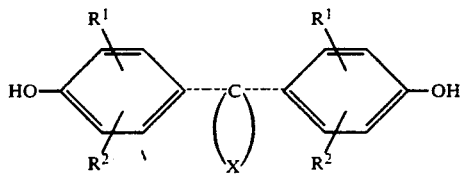

(I)

wherein:

$R^1$ and $R^2$ (same or different) represent hydrogen, halogen, a $C_1$-$C_8$ alkyl group, a $C_5$-$C_6$ cycloalkyl group, a $C_6$-$C_{10}$ aryl group or a $C_7$-$C_{12}$ aralkyl group;

X represents the necessary atoms to close a 5- to 8-membered cycloaliphatic ring which is substituted with one or more $C_1$-$C_6$ alkyl groups or 5- or 6-membered cycloalkyl groups or carries fused-on 5- or 6-membered cycloalkyl groups.

2. Dye-donor element according to claim 1, wherein X represents the necessary atoms to close a 5- or 6-membered cycloaliphatic ring.

3. Dye-donor element according to claim 2, wherein X is dialkyl substituted in Beta position to the diphenyl-substituted C-atom.

4. Dye-donor element according to claim 3, wherein the diphenol corresponding to formula (I) is 1,1-bis-(4-hydroxyphenyl)-3,3,5-trimethylcyclohexane.

5. Dye-donor element according to claim 4, wherein said polycarbonate is a homopolycarbonate.

6. Dye-donor element according to claim 1, wherein said polycarbonate is derived from a diphenol corresponding to formula (I) and a diphenol corresponding to formula (VII)

HO-Z-OH (VII)

wherein Z represents an aromatic residue having from 6 to 30 C atoms that can contain one aromatic nucleus or more than one aromatic nucleus and that may be substituted and may contain aliphatic residues or cycloaliphatic residues or heteroatoms as bonds between the separate aromatic nuclei.

7. Dye-donor element according to claim 6, wherein the diphenol corresponding to formula (VII) is 2,2-bis-(4-hydroxyphenyl)-propane.

8. Dye-donor element according to claim 6, wherein the amount of diphenols corresponding to formula (I) in the mixture of diphenols is between 25 and 75 mole %.

9. Dye-donor element according to claim 1, wherein the amount of polycarbonate derived from a diphenol corresponding to formula (I) in the heat-resistant layer is at least 10% by weight.

10. Dye-donor element according to claim 1, wherein the heat-resistant layer further comprises a lubricant.

11. Dye-donor element according to claim 1, wherein a top coat containing a lubricant is coated on top of said heat-resistant layer.

12. Dye-donor element according to claim 10, wherein the lubricant is polysiloxane-polyether copolymer.

13. Dye-donor element according to claim 1, wherein a subbing layer is provided between the support and the heat-resistant layer.

14. Dye-donor element according to claim 13, wherein said subbing layer comprises poly(vinylidene-chloride-co-acrylonitrile) or a polyester or an organic titanate.

15. Dye-donor element according to claim 13, wherein said subbing layer further comprises an aromatic polyol.

* * * * *